United States Patent [19]

Ofenstein

[11] Patent Number: 4,990,026

[45] Date of Patent: Feb. 5, 1991

[54] PROCESS FOR LOWERING BUILDING STRUCTURES

[75] Inventor: Josef Ofenstein, Krailling, Fed. Rep. of Germany

[73] Assignee: Alfred Kunz GmbH & Co., Munich, Fed. Rep. of Germany

[21] Appl. No.: 301,010

[22] Filed: Jan. 24, 1989

[30] Foreign Application Priority Data

Feb. 8, 1988 [DE] Fed. Rep. of Germany ..... 3803743

[51] Int. Cl.[5] ..... E02D 23/06

[52] U.S. Cl. ..... 405/8; 405/249; 376/273

[58] Field of Search ..... 376/260, 273, 274, 272, 376/203; 405/8, 9, 10, 128, 129, 249, 257; 252/626, 633

[56] References Cited

U.S. PATENT DOCUMENTS

| | | | |
|---|---|---|---|
| 2,065,003 | 12/1936 | Widugier | 405/8 |
| 2,596,788 | 5/1952 | Perkins | 405/8 |
| 2,678,540 | 5/1954 | Lorenz | 405/249 |
| 3,755,079 | 8/1973 | Weinstein et al. | 376/273 |
| 4,483,790 | 11/1984 | Gaiser | 376/273 |
| 4,923,338 | 5/1990 | Hertle et al. | 405/229 |

FOREIGN PATENT DOCUMENTS

| | | |
|---|---|---|
| G 2806V/84c | 2/1952 | Fed. Rep. of Germany . |
| 782245 | 5/1935 | France . |
| 432682 | 7/1935 | United Kingdom . |

*Primary Examiner*—Daniel D. Wasil

*Attorney, Agent, or Firm*—Fleit, Jacobson, Cohn, Price, Holman & Stern

[57] ABSTRACT

In a process of lowering building structures, such as shutdown nuclear power plants or building structures which are to be erected as they are lowered, a caisson is constructed below the bed plate of the building structure. The caisson has a reinforced top plate for supporting the building structure by means of supporting elements and a reinforced concrete ring which depends from the rim of the top plate to constitute a cutting edge. A transfer duct, which is lowered with the top plate, is provided adjacent the rim of the top plate. Superatmospheric pressure is maintained by means of air locks in a working chamber which is defined under the top plate and enclosed by the ring. To permit superatmospheric air pressure to be maintained in the working chamber, even when the transfer duct is extended during the lowering process, the top plate is connected at its rim to the bed plate by a sealing wall and is formed with an aperture which connects the working chamber to the space between the top plate and the bed plate. Air locks extending through the sealing wall are provided between the space and the transfer duct.

4 Claims, 1 Drawing Sheet

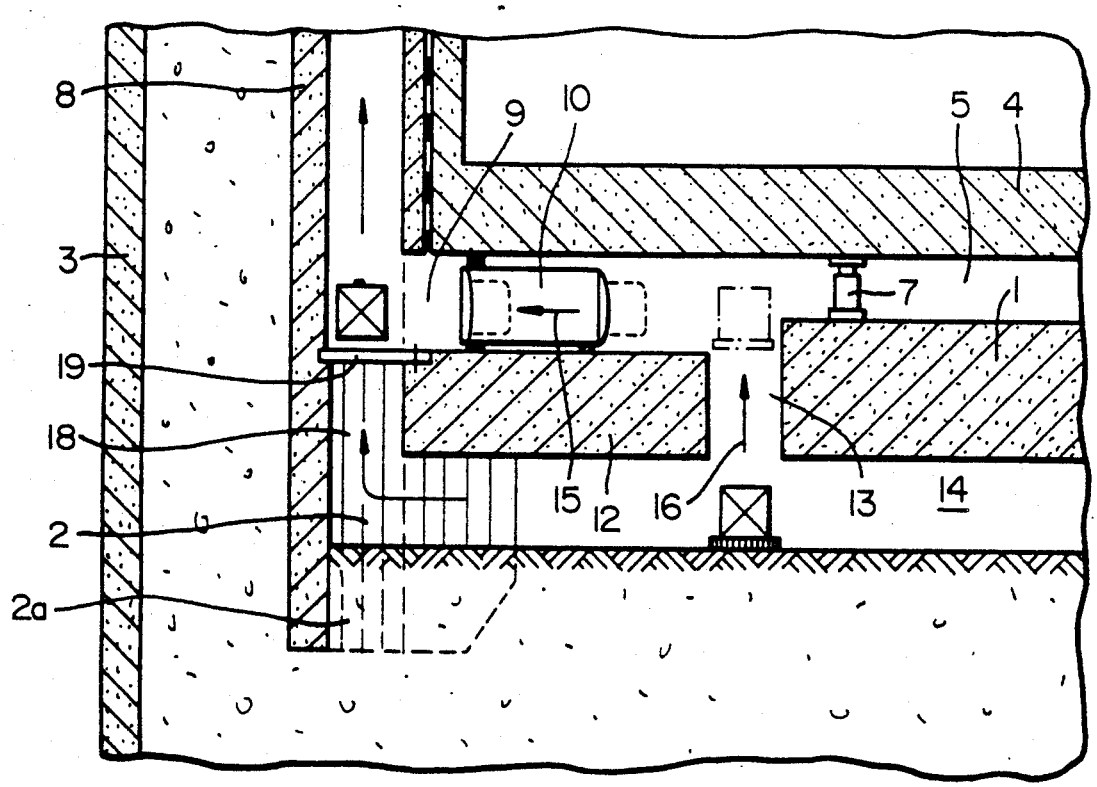
FIG. 1
FIG. 2
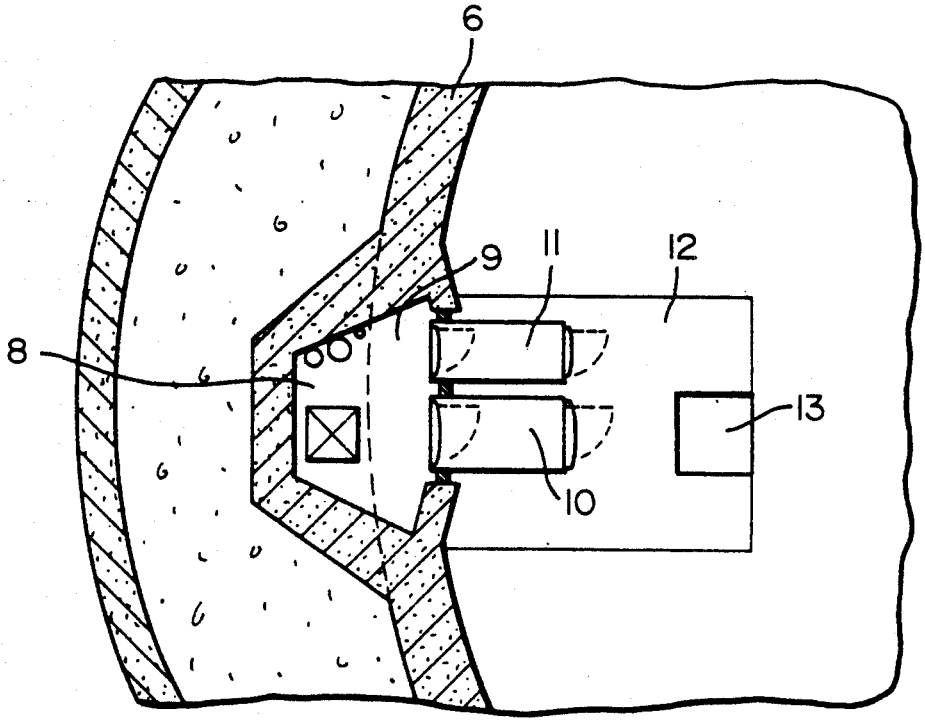

PROCESS FOR LOWERING BUILDING STRUCTURES

BACKGROUND OF THE INVENTION

1. Field of the Invention

This invention relates to a process for lowering building structures, such as shutdown nuclear power plants or building structures which are to be erected as they are lowered, wherein a caisson is constructed below a bed plate of the building structure, the caisson comprising a reinforced top plate for supporting the building structure by means of supporting elements and a reinforced concrete ring, which depends from the rim of the top plate and constitutes a cutting edge. At least one transfer duct, adapted to be lowered with the top plate, is provided adjacent the rim of the top plate and superatmospheric pressure is maintained, by means of air locks, in a working chamber which is defined under the top plate and enclosed by the ring.

2. Summary of the Invention

Processes of the above kind are disclosed in German Pat. application P 38 02 910.3, which is not a prior publication. In such processes the working chamber formed in the caisson communicates with one or more laterally disposed transfer ducts of reinforced concrete, which are used for the transfer of persons and material. In the working chamber a superatmospheric pressure is to be maintained which is sufficient to displace ground water, and which may amount to about 2 bars if the ground water table is to be lowered. To maintain this pressure, compressed air locks are provided in a portion of the transfer duct which is disposed above the surface. To prevent entry into the ground of the portion of the transfer duct which contains the air locks, as the caisson is progressively lowered, the transfer ducts must be extended at suitable intervals and the air locks must be shifted to higher locations. For these operations, the working chamber must temporarily be relieved of superatmospheric air pressure. Such relief of superatmospheric air pressure from the working chamber may result in an inrush of water, which may have an adverse effect on equipment in the working chamber and accordingly should be avoided.

It is an object of the invention to provide a process of the kind described in which superatmospheric air pressure can be maintained in the working chamber of the caisson even when the transfer duct must be extended after corresponding lowering steps.

In accordance with the invention, in a process of the kind described, the top plate is connected at its rim to the bed plate by a sealing wall and is formed with an aperture, which connects the working chamber to the approximately disk-shaped space between the top plate and the bed plate, and air locks extending through the sealing wall of the transfer duct are provided between said disk-shaped space and the transfer duct. In this process, superatmospheric air pressure in the working chamber can be maintained even when the transfer ducts must be extended due to the progress of the lowering operation. Material to be handled and persons who enter and leave may pass through air locks, which are provided in the disk-shaped space between the top plate and the bed plate of the building structure, on the one hand, and the transfer duct or ducts, on the other hand. Through this arrangement of air locks, atmospheric pressure may be maintained in the transfer ducts.

The maintenance of superatmospheric air pressure in the working chamber affords a further advantage in that changeable and uncontrollable load conditions, which could otherwise occur in the working chamber when it is relieved of superatmospheric air pressure, will be substantially prevented. The superatmospheric air pressure in the working chamber will result in an exactly defined back pressure, which produces lifting forces opposing the weight of the building structure. The forces acting on the caisson will depend on the weight of the building structure less the frictional forces acting between the caisson and the building structure, on the one hand, and the surrounding soil, on the other hand, and less the lifting forces which are due to the superatmospheric air pressure in the working chamber. The lifting forces which are due to the superatmospheric air pressure in the working chamber may amount to about 50% of the lowering pressure if considerable frictional forces are to be overcome. If the working chamber were temporarily relieved of the back pressure, this might result in an undesired and uncontrollable subsidence or slipping of the caisson.

The opening in the top plate is suitably disposed near the transfer duct or ducts so that the transfer paths may be short and it may be sufficient to provide the transfer ducts in a larger height than over the remaining region of the disk-shaped space.

BRIEF DESCRIPTION OF DRAWINGS

FIG. 1 is a longitudinal sectional view of a caisson having a top plate which supports the bed plate of a building structure to be lowered, and a transfer duct connected to the caisson.

FIG. 2 is a transverse sectional view of the arrangement shown in FIG. 1 in the region of a space between the top plate and the bed plate.

DETAILED DESCRIPTION OF THE PREFERRED EMBODIMENT

An illustrative embodiment of the invention will now be explained more in detail with reference to the drawings.

A caisson consists of a reinforced concrete top plate 1 and a reinforced concrete ring 2, which is connected to the rim of the top plate and constitutes a cutting edge 2*a*. In the position shown in FIG. 1, the caisson has already been lowered a certain distance into the ground. The lowering is effected inside previously formed diaphragm walls 3, which, as illustrated, are spaced around the caisson and the building structure. The diaphragm walls 3 constitute a cylindrical enclosure, which at a depth below the final level of the caisson may be provided with a watertight sole formed by the injection of a cement suspension, if the diaphragm walls do not reach sealing strata.

It will be understood that the caisson may be rectangular or polygonal in cross section.

The exposed bed plate 4 of the building structure to be lowered is supported by presses 7 on the top plate 1 of the caisson so that a disk-shaped space 5 is enclosed at its periphery by an annular wall 6, which is integrally joined to the top plate 1. A seal made of elastic and/or plastic material may additionally be provided between the wall 6, which confines the space 5, and the bed plate 4, so that a certain freedom of movement of the bed plate 4 relative to the top plate 1 is provided.

The caisson communicates with a transfer duct 8 of reinforced concrete. A passage 9 extending through the annular wall 6 connects the interior of the transfer duct 8 to the disk-shaped space 5. Air locks are contained in the passage 9 and include a lock 10 for material and a lock 11 for persons. Said air locks are of known type. In order to increase the height of the transfer passage, the air locks 10, 11 open into the disk-shaped space 5 between the bed plate 4 and the top plate 1, which may have a thickness of 3 to 4 meters, at a relatively thin portion 12 of the top plate 1. The portion 12 of the top plate 1 is formed with a through aperture 13, which connects the disk-shaped space 5 to a working chamber 14 in the caisson. Material may be transferred from the working chamber 14 in the direction indicated by the arrows 15, 16 through the opening 13 and the lock 10. Because the air locks 10, 11 are disposed in an opening of the wall 6 between the disk-shaped space 5 and the transfer duct, superatmospheric air pressure in the working chamber 14 can be maintained even as the transfer duct 8 is extended during progress of the lowering operation.

When depths have been reached in which superatmospheric pressure in the working chamber 14 is not required, the transfer duct may directly communicate with the working chamber 14. To that end an aperture 18 is provided in the top plate 1 near its periphery and in the ring 2. Aperture 18 can be closed by a cover 19 adjacent the top level of the top plate 1. When there is no need for compressed air in the working chamber 14, the cover 19 is removed so that the transfer duct can be extended through the aperture 18 into the working chamber 14.

What I claim is:

1. In a process for lowering a building structure into the ground, the steps comprising:

constructing a caisson below a bed plate of the building structure, which caisson has a reinforced top plate for supporting the building structure by means of supporting elements, a space between the bed plate and the top plate, and a reinforced concrete ring, which depends from a rim of the top plate and constitutes a cutting edge, providing at least one transfer duct, to be lowered with the top plate, extending upwardly from the rim of the top plate, maintaining superatmospheric pressure, in a working chamber which is defined under the top plate, and enclosed by the ring, connecting the top plate to the bed plate by a vertically extending sealing wall located adjacent the rim of the top plate, forming an aperture in the top plate, which connects the working chamber to the space between the top plate and the bed plate, and providing air locks extending through the sealing wall for selectively providing communication between said space and the transfer duct.

2. A building structure to be lowered into the ground, including:

a caisson constructed below a bed plate of the building structure, which caisson comprises a reinforced top plate supporting elements between the top plate and the bed plate of the building structure, a space between the bed plate and top plate, a reinforced concrete ring, which depends from a rim of the top plate, and constitutes a cutting edge, at least one transfer duct, to be lowered with the top plate, the transfer duct extending upwardly from the rim of the top plate, a working chamber defined under the top plate and enclosed by the ring, means for maintaining a superatmospheric pressure in the working chamber, a vertically extending sealing wall connecting the top plate to the bed plate, the sealing wall being located adjacent the rim of the top plate, an aperture in the top plate, which connects the working chamber to the space between the top plate and the bed plate, and air lock means extending through the sealing wall between said space and the transfer duct for selectively providing communication between the transfer duct and the working space.

3. A structure according to claim 2 wherein the air lock means comprises a pair of parallel air locks.

4. A structure as defined in claim 2 including an outer passage formed through the ring connecting said chamber to the transfer duct, and removable cover means for obturating said passage.

* * * * *